US008044316B2

(12) United States Patent
Ito

(10) Patent No.: US 8,044,316 B2
(45) Date of Patent: Oct. 25, 2011

(54) SLIDE OPERATION APPARATUS AND KNOB THEREFOR

(75) Inventor: Masafumi Ito, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 349 days.

(21) Appl. No.: 12/389,316

(22) Filed: Feb. 19, 2009

(65) Prior Publication Data

US 2009/0211889 A1 Aug. 27, 2009

(30) Foreign Application Priority Data

Feb. 21, 2008 (JP) ..... 2008-040006

(51) Int. Cl.
*H01H 15/10* (2006.01)
*H01H 9/18* (2006.01)

(52) U.S. Cl. ..... 200/547; 200/550; 200/296; 200/5 R; 200/330

(58) Field of Classification Search ..... 200/5 R, 200/5 A, 547–550, 329–331, 17 R, 18, 252, 200/296, 308; 345/184; 338/68, 74, 160; D13/158–174
See application file for complete search history.

(56) References Cited

U.S. PATENT DOCUMENTS

| | | | | |
|---|---|---|---|---|
| 2,903,633 | A * | 9/1959 | Cother | 200/252 |
| 3,736,801 | A * | 6/1973 | Bloom et al. | 74/89 |
| 3,816,686 | A * | 6/1974 | Budd et al. | 200/330 |
| D398,289 | S * | 9/1998 | Burke | D13/162 |
| 5,977,955 | A * | 11/1999 | Jaeger | 345/172 |
| 7,291,797 | B2 * | 11/2007 | Yang | 200/547 |
| 7,710,237 | B2 * | 5/2010 | Kato | 338/160 |

FOREIGN PATENT DOCUMENTS

| | | |
|---|---|---|
| JP | 545857 | 6/1993 |
| JP | 8137463 | 5/1996 |

* cited by examiner

*Primary Examiner* — Michael Friedhofer
(74) *Attorney, Agent, or Firm* — Morrison & Foerster LLP

(57) ABSTRACT

A slide operation apparatus capable of ensuring the operability of a knob and improving the visibility of scales on a panel surface of an electronic instrument, without the need of increasing a widthwise space required for mounting the slide operation apparatus on the panel surface. Scales indicating positions in slide movement direction are marked on the panel surface of the electronic instrument on which slide operation apparatuses are mounted. Each slide operation apparatus has a knob adapted to be operated to make a reciprocating slide movement on the panel surface. The knob has its mounting portion whose width is smaller than that of a plate portion and whose left and right end surfaces are receded inwardly from those of the plate portion. The knob has a bottom-side narrow-width portion in which a facing surface is narrower in width in slide movement direction than a finger-operated surface.

10 Claims, 4 Drawing Sheets

SLIDE OPERATION APPARATUS AND KNOB THEREFOR

BACKGROUND OF THE INVENTION

1. Field of the Invention

The present invention relates to a slide operation apparatus having a knob disposed on a panel surface of an electronic instrument, the knob being operable for sliding movement on the panel surface marked with scales. The present invention also relates to the knob for the slide operation apparatus.

2. Description of the Related Art

Conventionally, an electronic instrument such as a mixer apparatus is provided with fader operating devices or other slide operation apparatuses with which various parameters are set. For example, Japanese Laid-open Utility Model Registration Publication No. 05-45857 and Japanese Laid-open Patent Publication No. 08-137463 disclose a slide operation apparatus having a knob disposed to project from a slit or a guide groove formed in a panel surface of an electronic instrument. The knob is operable for sliding movement on the panel surface along the slit. Knob position scales are marked on the panel surface of the electronic instrument.

The knob typically has its upper surface (finger-operated surface) operable by finger and a bottom surface (facing surface) thereof facing the panel surface of the electronic instrument. In the slide operation apparatus disclosed in Japanese Laid-open Utility Model Registration Publication No. 05-45857, left and right side surfaces of the knob extending between the finger-operated surface and the facing surface are made flat, and the finger-operated surface and the facing surface each have a uniform width along the slide movement direction. A mark portion is provided at a central part in slide movement direction of the finger-operated surface from which the mark portion extends to central parts in slide movement direction of the left and right side surfaces of the knob. An operator is able to find a current knob position by reading one of the scales on the panel surface which is pointed out by the mark portion of the knob.

However, most parts of scales located in an area on the panel surface where the knob is currently positioned are hidden by the knob, and only outer parts of the scales extending outward laterally from the knob are visible. The operator must find a current knob position by reading visible scale parts. In the case of an electronic instrument such as a mixer apparatus having a large number of slide operation apparatuses mounted thereon, if a widthwise space required for mounting each slide operation apparatus on the panel surface is made large to increase the length of visible scale parts, the entire width of the electronic instrument becomes large. To reduce the width of the electronic instrument, the lengths of the scales must be made as short as possible, and as a result, visible scale parts extending outward laterally from the knob become extremely short in length. On the other hand, if the knob width is made narrow to enhance the ease of reading the scales, the operability of knob is deteriorated.

It is therefore difficult to satisfy both of ensuring knob operability and scale visibility and decreasing a widthwise space required for mounting a slide operation apparatus on a panel surface of an electronic instrument, which poses a problem.

SUMMARY OF THE INVENTION

The present invention provides a slide operation apparatus and a knob therefor, which are capable of ensuring the operability of the knob and improving the visibility of scales marked on a panel surface of an electronic instrument, without the need of increasing a widthwise space required for mounting the slide operation apparatus on the panel surface of the electronic instrument.

According to a first aspect of the present invention, there is provided a slide operation apparatus adapted to be mounted on an electronic instrument having a panel surface thereof marked with scales indicating positions in slide movement direction, the slide operation apparatus having a knob adapted to be operated for a reciprocating slide movement on the panel surface, wherein the knob has an upper surface thereof forming a finger-operated surface adapted to be operated and a bottom surface thereof forming a facing surface adapted to be disposed to face the panel surface of the electronic instrument, and the knob includes a bottom-side narrow-width portion which extends in the slide movement direction and in which the facing surface is narrower in width than the finger-operated surface.

With the slide operation apparatus according to the present invention, it is possible to ensure the operability of the knob and improve the visibility of scales, without the need of increasing a widthwise space required for mounting the slide operation apparatus on the panel surface.

The bottom-side narrow-width portion can be provided at its predetermined position with a projection portion which is adapted to be disposed to face the scales marked on the panel surface of the electronic instrument.

A mark portion visually recognizable in terms of its shape or color can be provided at a predetermined position in the slide movement direction on the finger-operated surface of the knob, a projection portion can be provided on the knob at a same position in the slide movement direction as that of the mark portion, so as to project from the knob in a width direction, and the projection portion can have a bottom surface which is larger in width than a part of the facing surface of the knob in which the projection portion is not provided.

In this case, a current knob position can more easily be found by reading a scale pointed out by the projection portion which is at the same position as that of the mark portion.

According to a second aspect of the present invention, there is provided a knob adapted to be mounted to a shaft member of a slide operation apparatus, the shaft member being disposed in a main body of the slide operation apparatus for a reciprocating slide movement in a slide movement direction, comprising a knob body having a finger-operated surface and a finger-operated surface side portion, a bottom-side narrow-width portion narrower in width than the finger-operated surface side portion of the knob body as viewed in a width direction of the knob, the bottom-side narrow-width portion having a bottom surface thereof constituting a bottom surface of the knob and a side surface thereof located inward of a side surface of the finger-operated surface side portion of the knob body as viewed in the width direction of the knob, and a projection portion having an end surface thereof located outward of the side surface of the bottom-side narrow-width portion as viewed in the width direction of the knob.

With the knob according to the present invention, it is possible to improve the visibility of scales marked on a panel surface of an electronic instrument on which is disposed a slide operation apparatus adapted to be mounted with knobs, without the need of increasing a widthwise space required for mounting the slide operation apparatus on the panel surface and ensure the operability of the knob.

The end surface of the projection portion can be located at or short of a position where a side surface of the knob body is located.

The knob body can include a mounting portion configured to be mounted with the shaft member of the slide operation apparatus, the mounting portion can include a knob bottom surface side portion at least by which the bottom-side narrow-width portion is constituted, and the projection portion can project outwardly of the side surface of the bottom-side narrow-width portion in the width direction of the knob.

The mounting portion can be formed into a cylindrical shape, and the projection portion can extend outwardly from an outer surface of the mounting portion in the width direction of the knob.

The knob body can have a knob bottom side portion whose side surface extends obliquely inward in the width direction of the knob toward the bottom surface of the knob, the bottom-side narrow-width portion can be constituted at least by the knob bottom side portion of the knob body, the projection portion can extend outwardly from a side surface of the knob bottom side portion of the knob body in the width direction of the knob, and the knob bottom side portion of the knob body can be configured to be mounted with the shaft member of the slide operation apparatus.

A mark portion visually recognizable in terms of its shape or color can be provided at a predetermined position in the slide movement direction on the finger-operated surface of the knob, and the projection portion can be provided on the knob at a same position in the slide movement direction as that of the mark portion.

Further features of the present invention will become apparent from the following description of an exemplary embodiment with reference to the attached drawings.

DETAILED DESCRIPTION OF THE PREFERRED EMBODIMENT

The present invention will now be described in detail below with reference to the drawings showing a preferred embodiment thereof.

Figure 1A:
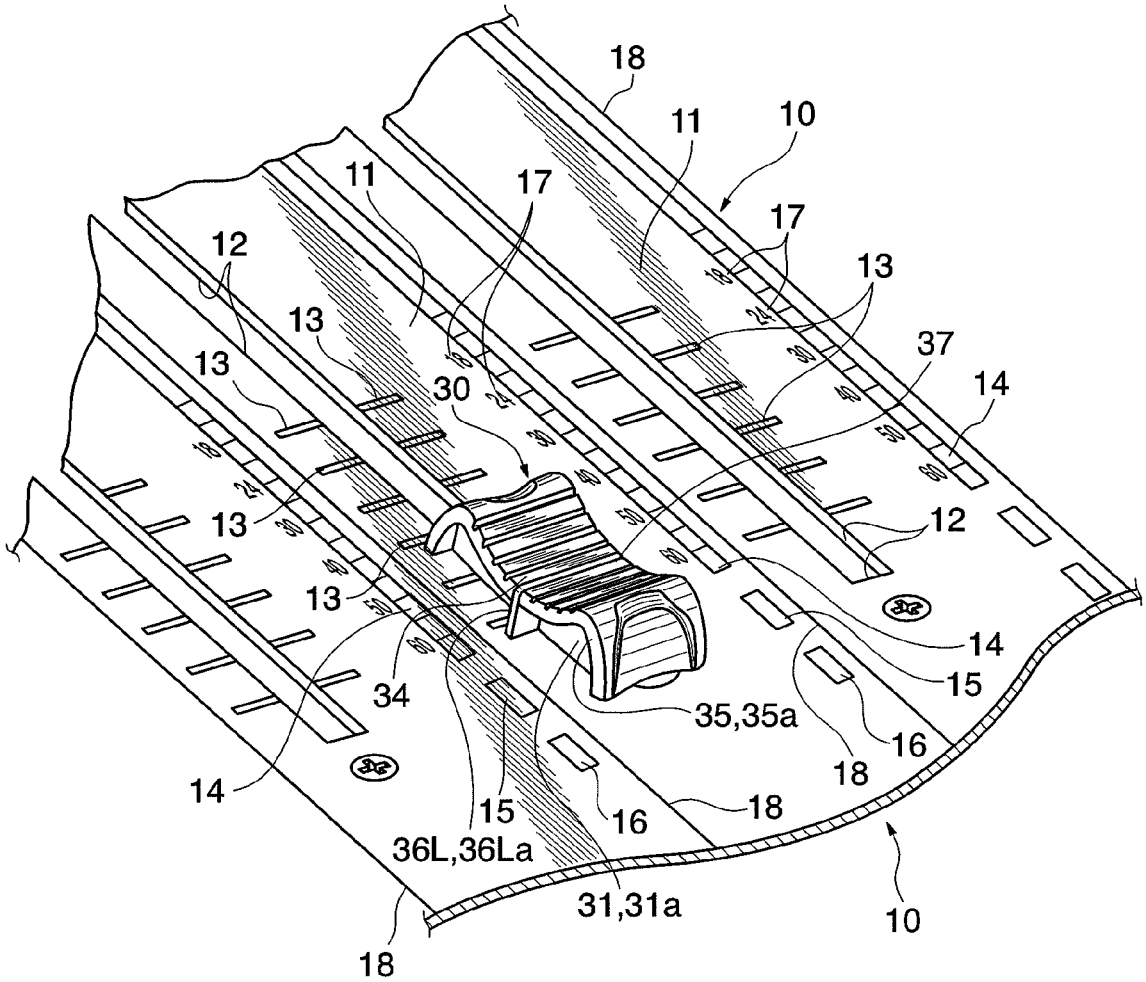
FIG. 1A is a fragmentary perspective view showing a part of a panel surface of an electronic instrument on which are mounted slide operation apparatuses according to one embodiment of this invention.
Figure 1B:
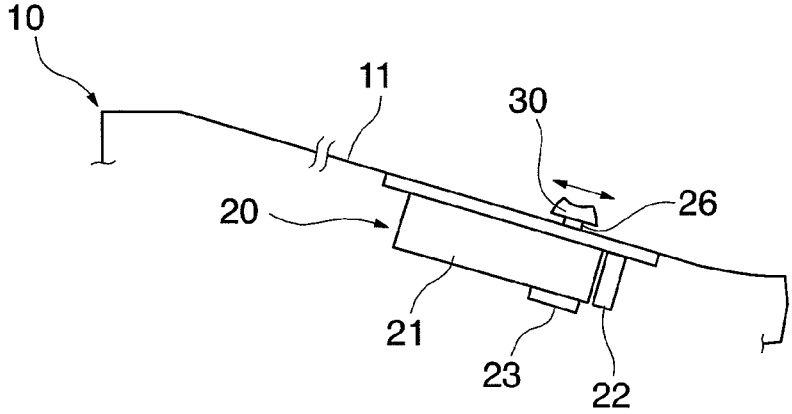
FIG. 1B is a schematic view showing a part of the electronic instrument in longitudinal cross section.

FIG. 1A shows in perspective view a part of a panel surface of an electronic instrument on which slide operation apparatuses according to one embodiment of this invention are mounted. FIG. 1B schematically shows the electronic instrument in longitudinal cross section.

The electronic instrument 10 is configured by way of example as a mixer apparatus, and includes a number of slide operation apparatuses 20 which are the same in construction as one another and juxtaposed in the direction extending perpendicular to the paper of FIG. 1B. As shown in FIG. 1B, each slide operation apparatus 20 includes a main body 21, a motor 22, a terminal 23, a knob 30, etc. The main body 21 is mounted to a predetermined part of the electronic instrument 10, e.g., a bottom surface of a panel thereof. In that case, the main body 21, the terminal 23, and the motor 22 are disposed below a panel surface 11 above which the knob 30 is disposed.

As shown in FIG. 1A, the panel surface 11 is divided by boundary lines 18 into mounting sections. Each one of the slide operation apparatuses 20 is disposed between each adjacent pair of boundary lines 18. The boundary lines 18 are drawn lines and not essentially required to be visually recognizable. The mounting sections are the same in construction as one another. An operator is on the right side as viewed in FIG. 1B. The right-to-left direction is determined as seen from the operator, which will be also referred to as the width direction of the knob 30. The side of the electronic instrument 10 close to the operator will be referred to as the front side.

As shown in FIG. 1A, in each mounting section on the panel surface 11, an indicator 14 having a large number of LEDs is provided near the right-side boundary line 18 and extends in the front-to-rear direction, and two LEDs 15, 16 are provided in front of the indicator 14. Slits 12 are formed that extend in the front-to-rear direction, and scales 13 are marked on the left and right sides of each slit 12. These scales 13 are marked, e.g., at constant intervals in the front-to-rear direction. Scale values 17 are indicated in numeric value on the right side of the scales 13.

The knob 30 is adapted to be operated for a reciprocating slide movement in the front-to-rear direction. The slide operation apparatuses 20 in the mounting sections correspond to respective channels, such as for example, input/output channels, master channels, and AUX channels. The settings of various parameters of these channels can be made by slidingly operating the knobs 30 of the slide operation apparatuses 20.

Figure 2A:
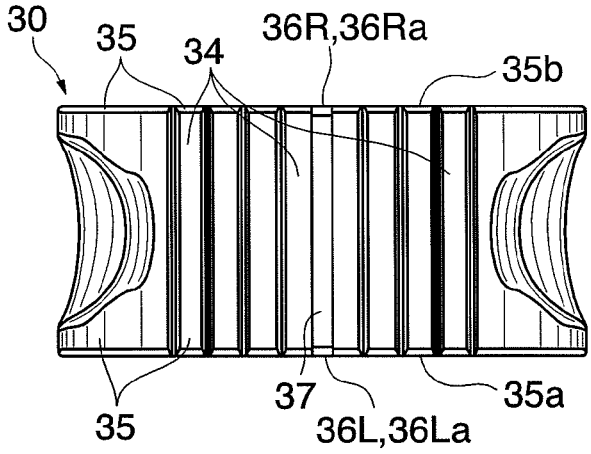
FIG. 2A is a top view of a knob.
Figure 2B:
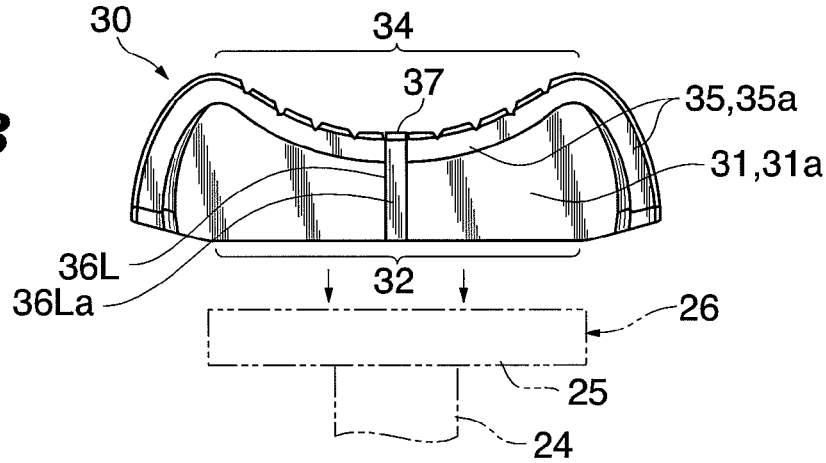
FIG. 2B is a left side view of the knob.
Figure 2C:
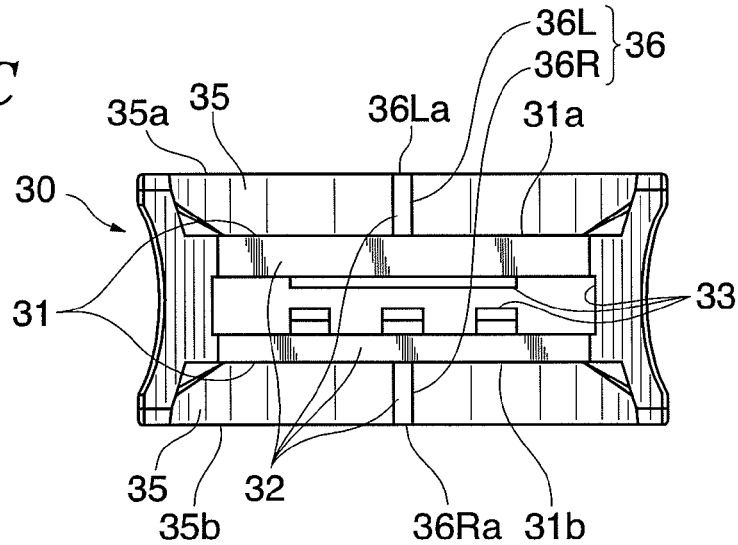
FIG. 2C is a bottom view of the knob.

FIGS. 2A, 2B, and 2C show the knob 30 in top view, left side view, and bottom view. Except for a mark portion 37 and projection ribs 36 (36L, 36R), the knob 30 is integrally formed by resin or the like. Alternatively, the entire knob including the mark portion 37 and the projection ribs 36 may be integrally formed.

The knob 30 includes a curved plate portion 35 which is uniform in thickness and a mounting portion 31 continuous to a lower inside of the plate portion 35. In this example, a knob body is constituted by the plate portion 35 and the mounting portion 31. As shown in FIG. 2C, the mounting portion 31 has its lower part formed with a fitting recess 33 opening toward below. The slide operation apparatus 20 includes a main body 21 (see FIG. 1B) and a T-shaped shaft member 26 (see FIG. 2B) disposed in the main body 21 so as to be movable in the front-to-rear direction. The T-shaped shaft member 26 has a shaft portion 24 and a head portion 25.

In a state that the shaft portion 24 extends through the slit 12 (see FIG. 1A) of the panel surface 11 from which the head portion 25 is exposed, the head portion 25 is fitted to the fitting recess 33 of the mounting portion 31, whereby the knob 30 is mounted to the T-shaped shaft member 26. When the knob 30 is operated, the shaft portion 24 of the T-shaped shaft member 26 moves along the slit 12 in the front-to-rear direction, and the knob 30 moves in the front-to-rear direction in unison with the T-shaped shaft member 26 relative to the main body 21 of the slide operation apparatus 20 and the panel surface 11 of the electronic instrument 10.

A finger-operated surface 34 adapted to be directly touched and operated by an operator's finger is formed by an upwardly directed part of the upper surface of the knob 30 (plate portion 35) (see FIGS. 2A, 2B). A facing surface 32 is formed by a part of the bottom surface of the knob 30 facing the panel surface 11 and extending in parallel therewith (see FIGS. 2B, 2C). The facing surface 32 forms most part of the bottom surface of the mounting portion 31. The knob 30 is configured to have front-rear symmetry, and formed in left-right symmetry except for the shape of the fitting recess 33.

The width of the plate portion 35 (distance between left and right end surfaces 35*a*, 35*b*) is uniform in the front-to-rear direction (see FIG. 2A, 2C). On the other hand, the width of the mounting portion 31 (distance between left and right side surfaces 31*a*, 31*b*) is smaller than the width of the plate portion 35 (finger-operated surface side portion of the knob body). The left and right side surfaces 31*a*, 31*b* of the mounting portion 31 are receded inwardly from the left and right end surfaces 35*a*, 35*b* of the plate portion 35 in left-right symmetry, but may be in left-right asymmetry.

The mark portion 37 is provided at a center part (predetermined position) in the front-to-rear direction of the plate portion 35 and extends in the width direction (see FIGS. 2A, 2B). The projection ribs (projection portions) 36L, 36R are provided to project leftward and rightward from the mounting portion 31 (see FIGS. 2B, 2C). The positions of the projection ribs 36L, 36R in the front-to-rear direction are the same as that of the mark portion 37. The end surfaces 36La, 36Ra of the projection ribs 36L, 36R are flush with the left and right end surfaces 35*a*, 35*b* of the plate portion 35. The distance between end surfaces of the projection ribs 36 is the same as the width of the plate portion 35.

The mark portion 37 and the projection ribs 36 are formed by a plate-like member integrally made of resin which is different in color from the plate portion 35. The plate-like member is fitted into a groove (not shown) formed in the plate portion 35 and the mounting portion 31, thereby being fixed to these portions 35, 31. However, the mark portion 37 and the projection ribs 36 may be separate from each other. Since the mark portion 37 is only required to be distinguishable from the finger-operated surface 34, the mark portion 37 may be designed to be distinguished in terms of characteristic in shape or color, and may be formed into any shape other than a straight line shape.

With the above described construction, the operator places a finger on the finger-operated surface 34 and slides the knob 30 in the front-to-rear direction, thereby setting a parameter or the like. At that time, the operator confirms a current position of the knob 30 representing a setting state by reading a scale value 17 indicated on the right side of a scale 13 pointed out by the mark portion 37.

The left and right side surfaces 31*a*, 31*b* of the mounting portion 31 are receded inwardly from the left and right end surface 35*a*, 35*b* of the plate portion 35 in the width direction. When viewed from right above, scales 13 are hidden by the plate portion 35 and difficult to see. However, much longer areas of these scales 13 can be seen from an obliquely left or right upper direction (see FIG. 1A). Thus, the visibility of scales 13 is improved. Nevertheless, the width of the plate portion 35 (i.e., the width of the finger-operated surface 34) can be the same as the conventional width. Therefore, the operability is not deteriorated, and the widthwise space (pitch) required for mounting each one of the slide operation apparatuses 20 is not needed to increase. The pitch can be narrowed, even if the width of the finger-operated surface 34 is made slightly larger than the conventional width.

In addition, since the projection ribs 36 are formed continuous to the mark portion 37, the operator can confirm a setting state based on the scale 13 pointed out by the lower ends of the projection ribs 36. In areas around the projection ribs 36, the mounting portion 31 is receded inward, and therefore the scale 13 can be seen satisfactorily.

As described above, to improve the visibility of scales 13, it is enough to provide the knob 30 with a portion (hereinafter referred to as the bottom-side narrow-width portion) which extends in the slide movement direction (front-to-rear direction) and in which the facing surface 32 is narrower in width than the finger-operated surface 34 (see FIGS. 2B, 2C). In this embodiment, the bottom-side narrow-width portion corresponds to a facing-surface-side part of the knob 30 in which the projection ribs 36 are not provided.

The improved visibility due to the presence of the projection ribs 36 can be attained so long as the projection ribs 36 somewhat project leftward and rightward from the left and right side surfaces 31*a*, 31*b* of the mounting portion 31. Thus, the left and right end surfaces 36La, 36Ra of the projection ribs 36 are not required to be flush with the left and right end surfaces 35*a*, 35*b* of the plate portion 35, and not required to extend in parallel to the vertical direction.

It is enough that the bottom surface of a part of the knob 30 in which the projection ribs 36 are provided is made broader in width than the bottom surface of a part of the facing surface 32 in which the projection ribs 36 are not provided. In this embodiment, only at the bottom surfaces of the projection ribs 36, the facing surface 32 is broader in width than the bottom surface of a part of the facing surface 32 where the projection ribs 36 are not provided. Preferably, the bottom surfaces of the projection ribs 36 are disposed as close as possible to the panel surface 11. It is not inevitably necessary to make the bottom surfaces of the projection ribs 36 flush with the mounting portion 31.

It is enough to dispose the projection ribs 36 at the same position in the slide movement direction as that of the mark portion 37. It is therefore unnecessary to dispose both the projection ribs 36 and the mark portion 37 at the center in the slide movement direction.

According to this embodiment, in most areas of the knob 30 as viewed in the slide movement direction, the facing surface 32 is narrower in width than the finger-operated surface 34. Therefore, the visibility of scales 13 can be improved while ensuring the operability of the knob 30, without the need of increasing a widthwise space required for mounting the slide operation apparatus 20 on the panel surface 11. Such arrangement is especially suitable for a slide operation apparatus having a knob which, when operated on a panel surface, can partly hide scales seen from right above, and especially effective for an electronic instrument mounted with a large number of slide operation apparatuses of this type.

Since the bottom surface of the projection ribs 36 provided at the same position in the slide movement direction as that of the mark portion 37 is broader in width than the bottom surface of that part of the facing surface 32 where the projection ribs 36 are not provided, a current position of the knob 30 can more easily be found based on the scale 13 pointed out by the projection ribs (projection portions) 36.

In this embodiment, the knob 30 (more specially, the knob body) is configured to have the plate portion 35 and the mounting portion 31 which are separate from each other, but such a separate construction is not essentially required. As shown by way of example in a modification in FIGS. 3A and 3B, the knob 30 only needs to be configured to have a bottom-side narrow-width portion.

Figure 3A:
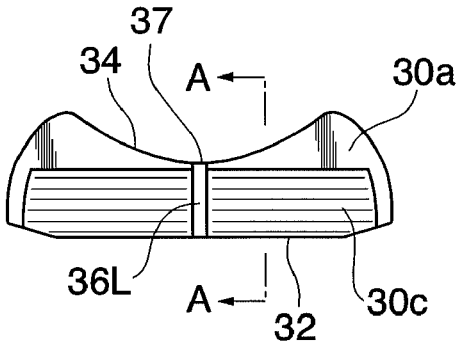
FIG. 3A is a left side view of a knob according to a first modification.
Figure 3B:
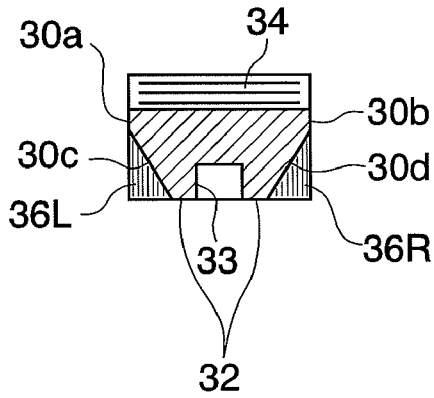
FIG. 3B is a section view taken along line A-A in FIG. 3A.

FIG. 3A shows in left side view a knob 30 according to a first modification, and FIG. 3B shows the knob 30 in cross section taken along line A-A in FIG. 3A. Lower left and right side surfaces 30*c*, 30*d* of the knob 30 (more specially, the knob body) are formed continuous to upper left and right side surfaces 30*a*, 30*b* of the knob 30. The lower side surfaces 30*c*, 30*d* are formed into tapered surfaces extending obliquely inward in the left-to-right direction toward downward (toward the bottom surface of the knob). This arrangement satisfies the requirement that the knob 30 has a bottom-side narrow-width portion extending in the slide movement direction.

As with the case of the knob shown in FIG. 1, the knob 30 has projection ribs 36L, 36R provided to project from lower side surfaces 30*c*, 30*d* of the knob 30 (side surfaces of a knob bottom side portion of the knob body) at the same position in the slide movement direction as that of a mark portion 37 in a finger-operated surface 34, thereby satisfying the requirement that the width of a bottom surface of a part of the facing surface 32 in which the projection ribs 36 are provided is broader than that of a bottom surface of a part of the facing surface 32 in which the projection ribs 36 are not provided.

Figure 3C:
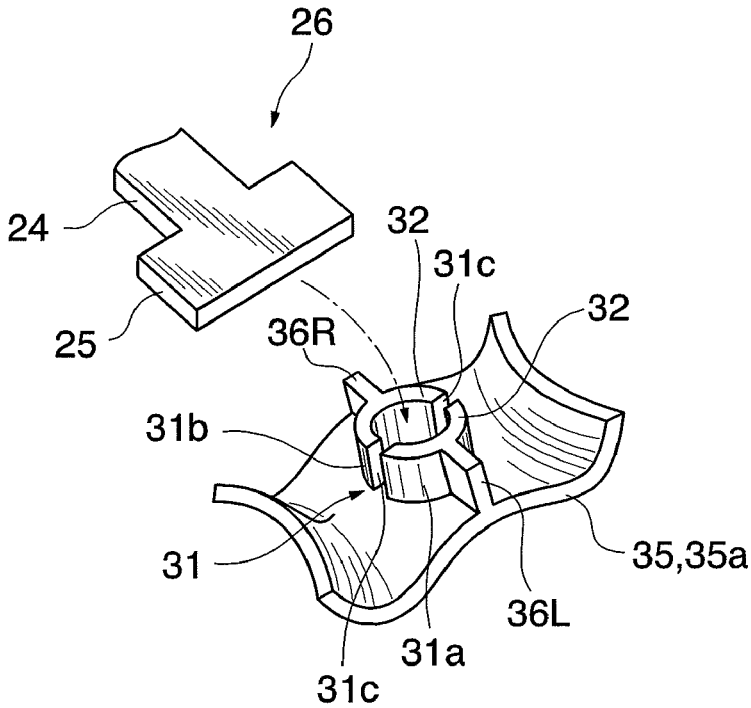
FIG. 3C is a perspective view of a knob according to a second modification as seen from obliquely below.

As shown by a modification in FIG. 3C, a side surface of a mounting portion 31 of a knob may not be formed into a flat surface. FIG. 3C shows a knob according to a second modification in perspective view as seen from obliquely below. In this modification, the mounting portion 31 of the knob is formed into a cylinder formed with a slit 31*c* which is an expanding slot, and left and right side surfaces 31*a*, 31*b* of the mounting portion 31 are each formed into a substantially semi-circular shape. Projection ribs 36L, 36R are formed to project from the side surfaces (outer surfaces) 31*a*, 31*b*. A head portion 25 of a T-shaped shaft member 26 is fitted into the slit 31*c*, whereby the knob is mounted to the T-shaped shaft member 26.

The bottom surface of the mounting portion 31 including the projection ribs 36 forms a facing surface 32. This modification satisfies the above-described two requirements since the knob has the projection ribs 36 and the side surfaces 31*a*, 31*b* of the mounting portion 31 are receded inwardly from the left and right end surfaces 35*a*, 35*b* of the plate portion 35, and therefore, the width of the bottom surface of a part of the facing surface 32 in which the projection ribs 36 are provided is broader than that of the bottom surface of a part of the facing surface 32 in which the projection ribs 36 are not provided.

As understood from the foregoing description, to satisfy the requirement that the knob must be provided with the bottom-side narrow-width portion extending in the slide movement direction, the width of the plate portion 35 may not be uniform in the slide movement direction. It is enough that the facing surface 32 is narrower in width than the finger-operated surface 34 at respective positions in the slide movement direction.

Figure 4A:
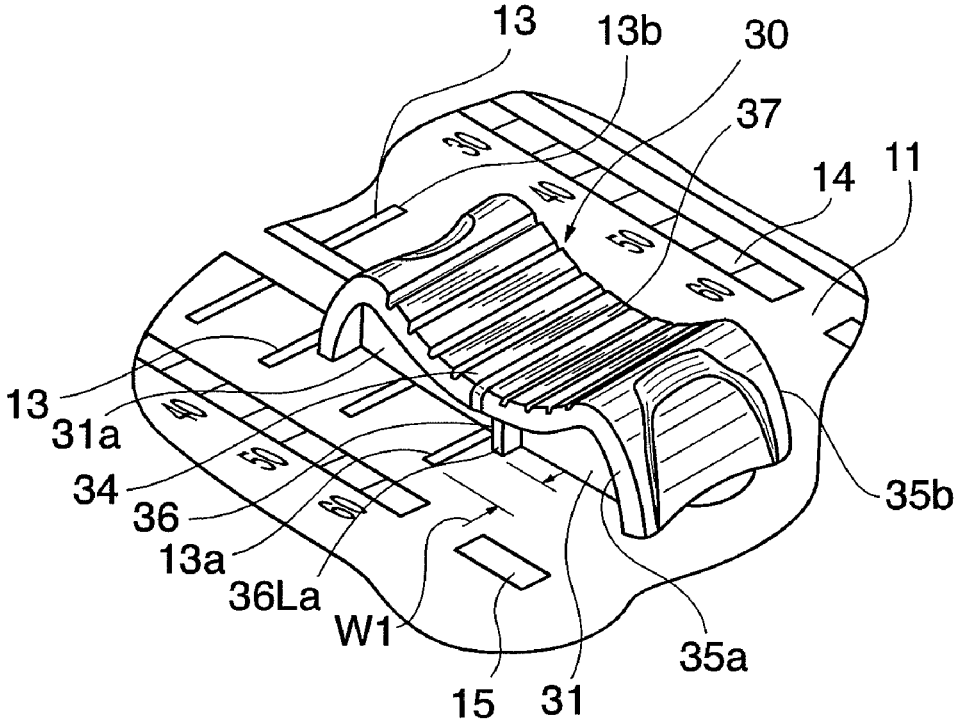
FIG. 4A is a fragmentary perspective view of a knob according to a third modification.

The above described embodiment may further be modified. In the embodiment, as shown in FIG. 1A, it is arranged that the outer end (shown at 13*a* in FIGS. 4A, 4B) of each of scales 13 and the outer surface (e.g., end surface 36La) of each projection rib 36 passing over the scales are at substantially the same position in the width direction so that a distance between the outer end of scale and the outer surface of projection rib is made zero (although the outer ends of scales are illustrated in FIG. 1A as being located slightly outward of the outer surfaces of projection ribs). Alternatively, as shown by a third modification in FIG. 4A, projection ribs 36 may be provided at longitudinally central parts of end surfaces 35*a*, 35*b* of a plate-like member 35 so as to be receded from the end surfaces 35*a*, 35*b*. As a result, there is produced a distance W1 between the outer end 13*a* of each scale 13 and the end surface (e.g., 36La) of a corresponding projection rib, whereby the visibility of scales is further improved than in the embodiment shown in FIG. 1A.

Figure 4B:
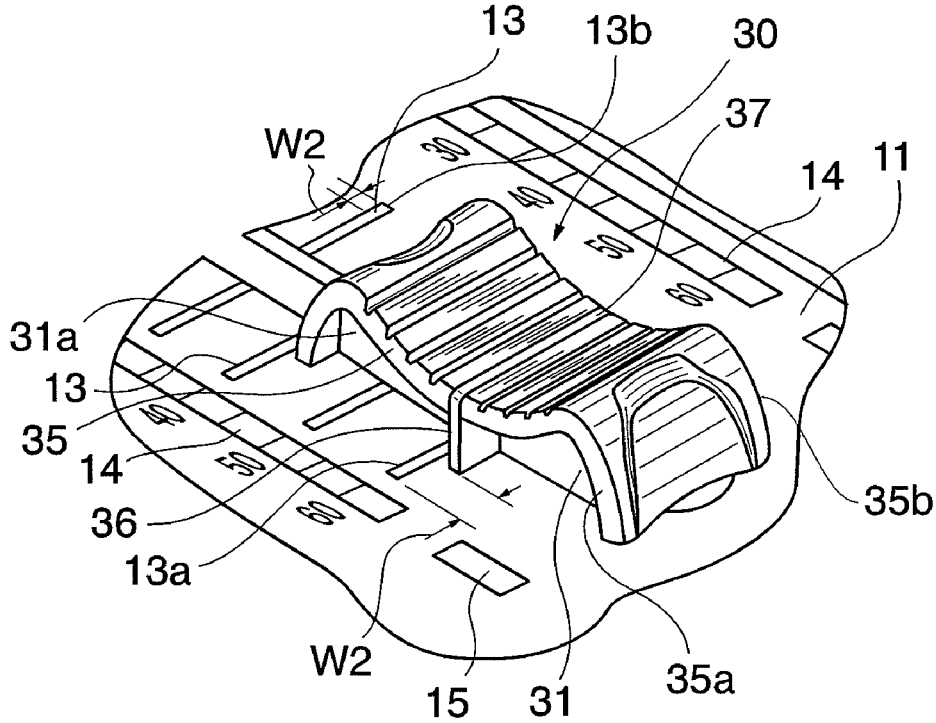
FIG. 4B is a fragmentary perspective view showing a knob according to a fourth modification and scales marked on a panel surface.

As shown by a fourth modification in FIG. 4B, outer ends 13*a* of scales 13 marked on a panel surface 11 may be extended outward by a distance W2 relative to end surfaces of projection ribs 36, with other construction of the knob 30 remaining the same as the embodiment in FIG. 1A. Also with this modification, the visibility of scales can further be improved than in the embodiment in FIG. 1A.

From the viewpoint of simplifying the construction, it is not essentially necessary to provide a projection portion such as projection ribs 36 in the knob. The slide movement direction is not limited to the front-to-rear direction so long as a reciprocating slide movement of the knob can be made in a given direction.

The electronic instrument to which the slide operation apparatus of this invention is applied is not limited to a mixer apparatus or other signal processing apparatus, and can be any electronic instrument in which a slide operation is carried out for some setting or processing.

What is claimed is:

1. A slide operation apparatus adapted to be mounted on an electronic instrument having a panel surface thereof marked with scales indicating positions in slide movement direction, the slide operation apparatus having a knob adapted to be operated for a reciprocating slide movement on the panel surface, wherein the knob has an upper surface thereof forming a finger-operated surface adapted to be operated and a bottom surface thereof forming a facing surface adapted to be disposed to face the panel surface of the electronic instrument, and the knob includes a bottom-side narrow-width portion which is provided at a predetermined position thereof with a projection portion which is adapted to be disposed to face the scales marked on the panel surface of the electronic instrument.

2. The slide operation apparatus according to claim 1, wherein a mark portion visually recognizable in terms of its shape or color is provided at a predetermined position in the slide movement direction on the finger-operated surface of the knob, a projection portion is provided on the knob at a same position in the slide movement direction as that of the mark portion, so as to project from the knob in a width direction, and the projection portion has a bottom surface which is larger in width than a part of the facing surface of the knob in which the projection portion is not provided.

3. The slide operation apparatus according to claim 1, wherein the bottom-side narrow-width portion extends in the slide movement direction and in which the facing surface is narrower in width than the finger-operated surface.

4. A knob adapted to be mounted to a shaft member of a slide operation apparatus, the shaft member being disposed in a main body of the slide operation apparatus for a reciprocating slide movement in a slide movement direction, comprising:

a knob body having a finger-operated surface and a finger-operated surface side portion; a bottom-side narrow-width portion narrower in width than the finger-operated surface side portion of said knob body as viewed in a width direction of the knob, said bottom-side narrow-width portion having a bottom surface thereof constituting a bottom surface of the knob and a side surface thereof located inward of a side surface of the finger-operated surface side portion of said knob body as viewed in the width direction of the knob; and a projection portion having an end surface thereof located outward of the side surface of said bottom-side narrow-width portion as viewed in the width direction of the knob.

5. The knob according to claim 4, wherein the end surface of said projection portion is located at a position where a side surface of said knob body is located.

6. The knob according to claim 4, wherein the end surface of said projection portion is located short of a position where a side surface of said knob body is located.

7. The knob according to claim 4, wherein said knob body includes a mounting portion configured to be mounted with the shaft member of the slide operation apparatus, said mounting portion includes a knob bottom surface side portion at least by which said bottom-side narrow-width portion is constituted, and said projection portion projects outwardly of the side surface of said bottom-side narrow-width portion in the width direction of the knob.

8. The knob according to claim 7, wherein said mounting portion is formed into a cylindrical shape, and said projection portion extends outwardly from an outer surface of said mounting portion in the width direction of the knob.

9. The knob according to claim 4, wherein said knob body has a knob bottom side portion whose side surface extends obliquely inward in the width direction of the knob toward the bottom surface of the knob, said bottom-side narrow-width portion is constituted at least by the knob bottom side portion of said knob body, said projection portion extends outwardly from a side surface of the knob bottom side portion of said knob body in the width direction of the knob, and the knob bottom side portion of said knob body is configured to be mounted with the shaft member of the slide operation apparatus.

10. The knob according to claim 4, wherein a mark portion visually recognizable in terms of its shape or color is provided at a predetermined position in the slide movement direction on the finger-operated surface of the knob, and the projection portion is provided on the knob at a same position in the slide movement direction as that of the mark portion.

* * * * *